United States Patent [19]

Scaglia

[11] Patent Number: 5,056,728

[45] Date of Patent: Oct. 15, 1991

[54] METHOD AND DEVICE TO SEIZE THE END OF A ROVING OR SLIVER AND MOVE IT TO A PREDETERMINED POSITION

[76] Inventor: Enzo Scaglia, 21, Via Monte Rosa, Milano, Italy, 20149

[21] Appl. No.: 566,262

[22] Filed: Aug. 13, 1990

Related U.S. Application Data

[63] Continuation-in-part of Ser. No. 249,319, Sep. 26, 1988, abandoned.

[30] Foreign Application Priority Data

Oct. 12, 1987 [IT] Italy ..... 22223 A/87

[51] Int. Cl.[5] ..... B65H 54/22

[52] U.S. Cl. ..... 242/35.6 E; 242/18 R; 242/128; 226/97

[58] Field of Search ..... 242/35.6 E, 35.6 R, 242/35.5 R, 35.5 A, 18 R, 128; 226/97

[56] References Cited

U.S. PATENT DOCUMENTS

| | | | |
|---|---|---|---|
| 2,681,729 | 6/1954 | Griset, Jr. | 226/97 X |
| 3,108,618 | 10/1963 | Kondo et al. | 242/35.6 E X |
| 3,236,464 | 2/1966 | Wey | 242/35.6 E X |
| 3,279,712 | 10/1966 | Furst | 242/35.5 R |
| 3,866,848 | 2/1975 | Abbott | 242/35.6 E |
| 3,966,141 | 6/1976 | Nishiyama et al. | 242/35.6 E X |
| 4,267,983 | 5/1981 | Leu | 242/35.6 E |

FOREIGN PATENT DOCUMENTS

| | | | |
|---|---|---|---|
| 0026360 | 4/1981 | European Pat. Off. | 226/97 |
| 2423493 | 11/1975 | Fed. Rep. of Germany | 242/35.6 E |

*Primary Examiner*—Stanley N. Gilreath

*Attorney, Agent, or Firm*—Lerner, David, Littenberg, Krumholz & Mentlik

[57] ABSTRACT

A method and device to seize the end of a roving, yarn or the like from a cop and carry it to a predetermined position envisages the use of an elongated hollow body wherein several ducts for feeding air or other gas are housed. The mouth of the hollow body is positioned near the end of the roving on the cop, the latter is detached and raised from the cop and subsequently sucked and/or pushed along said hollow body by means of one or more blowing and/or sucking jets. Finally, the hollow body opens to free the roving and is then removed.

16 Claims, 2 Drawing Sheets

METHOD AND DEVICE TO SEIZE THE END OF A ROVING OR SLIVER AND MOVE IT TO A PREDETERMINED POSITION

CROSS-REFERENCE TO RELATED APPLICATIONS

This application is a continuation-in-part of application Ser. No. 07/249,319 filed Sept. 26, 1988, now abandoned.

BACKGROUND OF THE INVENTION

1. Field of the Invention

The present invention concerns a method and a device to take the end of a roving or sliver from a rotating cop and carry it to a predetermined position, for example in correspondence with a textile machine, such as a spinner, in a completely automatic way and without damaging the roving or sliver.

2. Description of the Prior Art

At the present state of the art, the technique of machine feed envisages that the operation of seizing the end of the roving or sliver from a rotating cop and carrying it to a grasping device in a textile machine (for instance, the drawing rolling mill of a spinning machine), while simultaneously unwinding part of said roving or sliver, be performed almost completely manually. The automation of such an operation is therefore advisable not only for obvious economical reasons, but also for more strictly technical considerations, since the operations upstream and downstream of such devices are already completely automated and thus the presence of such a manual step may cause problems related to productive times within the whole process.

However, the reasons for having the manual step instead of an automated step is simple. The utmost care must be taken in seizing the end of a roving or sliver and moving it to another location; quite unlike the moving of yarns and similar large threads. As those skilled in the art can appreciate, rovings or slivers are quite delicate, and thus easily damaged. The construction and arrangement of certain devices for moving yarns or other larger threads has been found to be unsuitable for use in connection with rovings or slivers because the rovings or slivers are easily damaged when seized (if seizing is even provided for in such devices) and/or when moved or unwound. The cause of such damage can be as simple as the use of a relatively large burst or jet of air, as is typically employed in such devices to effect the movement of the yarn. Such a large burst or jet of air is required because of the typically narrow mouth sections employed by conventional devices.

There is therefore the need of a method and a device capable of automating the operation of drawing the end of a roving or sliver and carrying it to a predetermined position in association with a textile machine without damaging the same. There is also a need for this method and device which are adapted to seize and move the end of rovings on successive rotating cops without interfering with the unwinding of the rovings from previous cops.

OBJECTS OF THE INVENTION

An object of the present invention is to provide a method capable of solving the above-noted problems, automating the operation of drawing the end of a roving or sliver from a cop and carrying it to a predetermined position on a textile machine, without damaging said roving or sliver.

Another object of the present invention is to provide a device allowing to automate said operation of drawing and carrying the end of a roving or sliver, without damaging same.

It is another object of the present invention to provide a device and method which permits the seizing and moving of the end of a roving or sliver from one rotating cop to facilitate the unwinding of the roving or sliver from the rotating cop, and subsequently seizing and moving the end of a roving or sliver from a second rotating cop without interfering with the unwinding of the roving or sliver from the first rotating cop.

It is a more specific object of the present invention to provide a device which employs a suction technique having a jet of air of reduced velocity, as compared to the velocity of air required by conventional devices, for seizing and moving the roving or sliver without damaging the same.

SUMMARY OF THE INVENTION

More particularly, the present invention concerns a method for grasping the end of a roving or sliver from a cop and transferring it to a predetermined position, characterized in that it comprises the steps of: positioning an elongate hollow body between the area of the cop where the end of roving is present and said predetermined position such that said elongate hollow body conforms to the cop; detaching said end from the cop such that it is positioned near the entry of said elongate hollow body; drawing said end inside said elongated body by means of a pneumatic effect generated in said body by one or more blowing and/or sucking jets of air or other gas; feeding said end along the whole elongate hollow body up to said predetermined position, pushing it by means of said jets and possibly by means of additional pushing jets; opening and removing the elongate hollow body for movement and positioning adjacent to a successive cop so that said method can be repeated without interfering with the unwinding of the roving from the first cop.

Moreover, the invention concerns a device to grasp the end of a roving and send it to a predetermined position, characterized in that it comprises and elongate hollow body inside of which one or more ducts feeding air or other gas are provided, said ducts creating, when fed, such a negative and/or positive pressure in the body cavity, to be able of moving forward along the same, a roving, and in that said body can be opened to free the roving and to be moved to another cop for seizing and moving the end of a roving therearound, the elongate hollow body having a large mouth and being so constructed and arranged that being said mouth conforms to the rotating cop to leave little area between the cop and the mouth whereby the velocity of the air or gas fed to the ducts can be reduced, as compared to conventional devices, to protect the roving against damage.

BRIEF DESCRIPTION OF THE DRAWINGS

The invention will be now described more in detail with reference to the attached drawings which are given for illustrative and not limiting purpose, and wherein.

DESCRIPTION OF THE PREFERRED EMBODIMENTS

Figure 1:
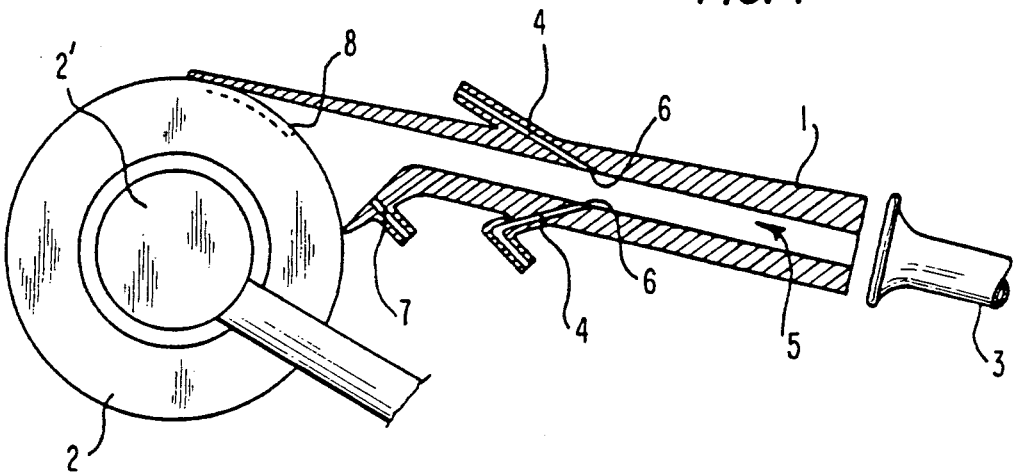
FIG. 1 is a plan view partly in section of a device according to the invention, positioned near a cop.

With reference first of all to FIG. 1, an elongate hollow body 1 is positioned between a cop 2, supported by an arm 2', and a preset position represented by the mouth of a guide tube 3. Contrary to said cop 2 and said guide tube 3, the hollow body 1 is represented in section in order to make the structure more comprehensible.

Figure 2:
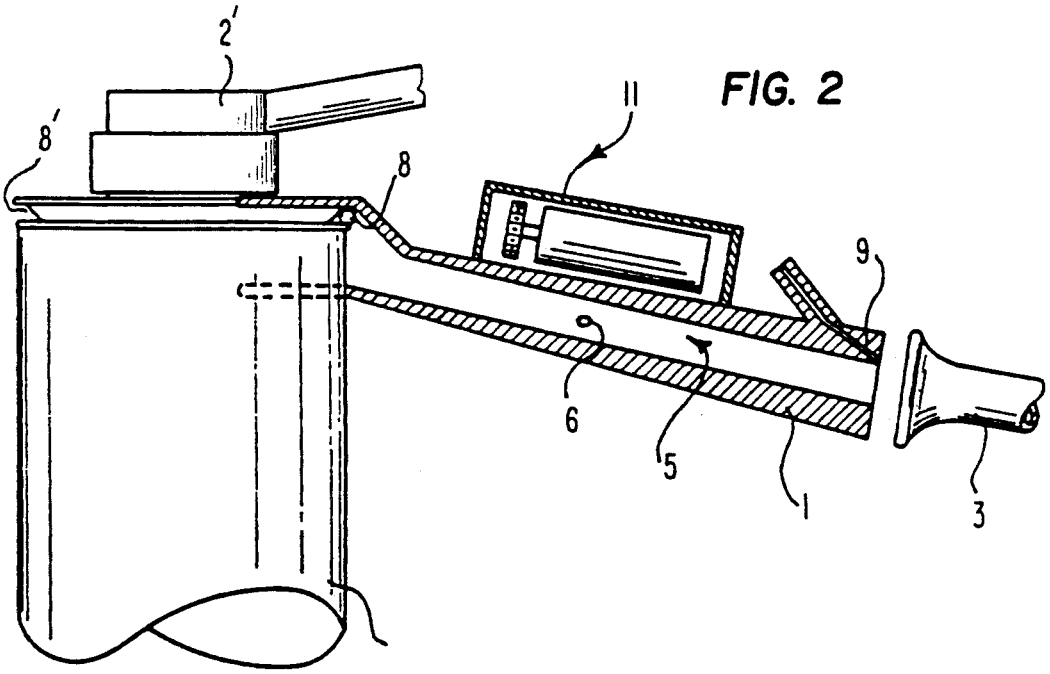
FIG. 2 is a side view partly in section of the device of FIG. 1.

As it can be seen in FIGS. 1 and 2, said body 1 defines a main duct on the side walls of which there are provided secondary ducts 4 adapted to put the external environment in communication with the inner cavity 5 of said hollow body 1. Said ducts 4 can be connected to a compressed air source or to a source of other compressed gas (not illustrated), and their position with respect to the walls of the hollow body 1 is such that, when fed with said gas, they create a Venturi effect inside said hollow body 1.

In this case, the Venturi effect causes a depression upstream from the outlet openings 6 of ducts 4 within the cavity 5 and a pressure downstream from said openings 6. Another duct 7 (connectable as well to a source of air or gas under pressure) is provided at the mouth of the elongate body 1, said mouth showing a particular asymmetrical shape, following the configuration of the side surface of the cop 2, starting from a position of substantial tangency to the same.

More specifically, and as shown in FIG. 1, the mouth of body 1 is defined by a first member which conforms to the cop in a substantially tangential manner, and the internal lip is directed at the cop in a substantially transverse manner. This internal lip, which houses duct 7 (discussed below), extends from the elongate portion of the second member—the elongate portion being generally parallel to the first member to form the relatively narrow cavity 5. More specifically, in FIG. 1, the first member conforms to the cop tangentially near the end 8 of the roving—that is, the upper portion of the "cross-sectional" body 1 in the area of the mouth. The second member is the lower portion of the "cross-sectional" body 1 in FIG. 1, and which carries the duct 7.

It is important to note that the mouth of the body 1 conforms to the side of the cop (that is, matches the arcuate shape of the cop), and is so constructed that a very small area is left between the body 1 and the side of the cop. In this manner, only a small amount of air can be entrained into the mouth of the body 1 when air is introduced into the cavity 5 via air ducts 4. The result of this is that only a small amount of air is all that must be introduced into ducts 4 in order to successfully seize and move the end of the roving. Such small amount of air is less than the damaging bursts or jets of air required by conventional devices to seize and move the roving. It is thus a "reduced" amount of air as compared to the bursts or jets of air from conventional devices which often damage the roving. With these reduced jets of air, it becomes possible to seize and move the roving without damaging the same. In other words, the non-damaging but requisite suction effect in the mouth and cavity of the body 1 is obtained notwithstanding the reduced flow rate, all due to the design of the mouth of the cop which mates with the arcuate side of the cop.

It should also be noted that if an imaginary line is drawn from the end of the first member of the body 1 to the end of the internal lip of the body 1, as shown in FIG. 1, such imaginary line will be substantially tangential to the arcuate shape of the cop or at substantially parallel to a tangent line on the arcuate shape of the cop. That is, the mouth of the body 1 is generally parallel to the tangent taken adjacent the end 8 of the roving. The arrangement of the duct 7, as discussed below, is thus such that the jet of air to facilitate the seizing of the roving is directed in a substantially tangential direction at the end of the roving, and upon detachment from the cop, the end of the roving is already directed towards and into the mouth and cavity 5.

Still further, it can be seen that the longitudinal axis of the cavity 5 is substantially perpendicular to the axis of the cop, thus providing an arrangement which differs from yarn-moving devices which are typically arranged with the suction chambers in line with the axis of the cop. Although these yarn-moving devices cannot be utilized for seizing and moving a roving or sliver anyway for the other reasons set forth above, this provides yet another distinction thereover.

As mentioned above, the angled position of the internal lip of said mouth serves to place the duct 7 in such a way that the air jet is tangentially directed to the cop 2. In this way, the jet coming from duct 7 can raise the roving 8, detach it from the cop 2 and position it approximately in the central area of said mouth, all while the cop is rotating. In order to make this operation easier, the roving is positioned in a seat 8' provided in the upper edge of the bobbin; and, by slightly forcing the roving end 8 into said seat 8', it is possible to obtain its stable positioning under normal conditions, and its easy detachment, thanks to the jet from duct 7, when the cop has to be unwound.

In the preferred embodiment, illustrated in FIGS. 1 and 2, the hollow body 1 has an additional duct 9, always connected to a source of air or other gas under pressure. Duct 9, when fed with air or other gas, provides an additional pushing jet to feed the roving end beyond the elongate body 1, for example into the guide tube 3 shown in FIGS. 1 and 2.

Figure 3:
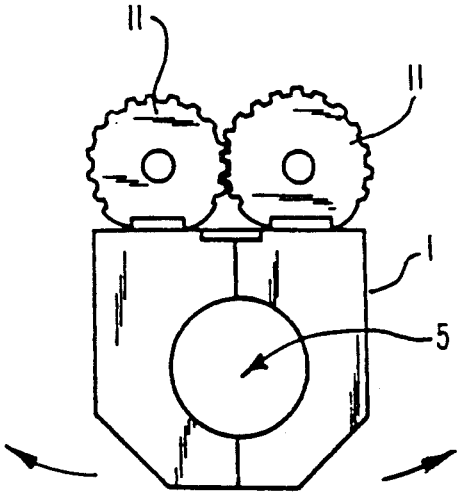
FIG. 3 is a front view of the device of the preceding Figures.

In order to allow release of the roving after its end has been carried from the bobbin 2 to the guide tube 3, the elongate hollow body 1 must be designed in a way it can be opened in its whole length. FIG. 3 shows a preferential embodiment, wherein the body 1 is formed by two halves hinged to each other along the upper side. Said halves can rotate around said hinged side under the control of a motor and a series of gears. In FIG. 3, motor and gears are diagrammatically shown by reference 11. With such a construction and arrangement, the body 1 can be moved from cop to cop without interfering with the unwinding of the roving from previous cops.

Figure 4:
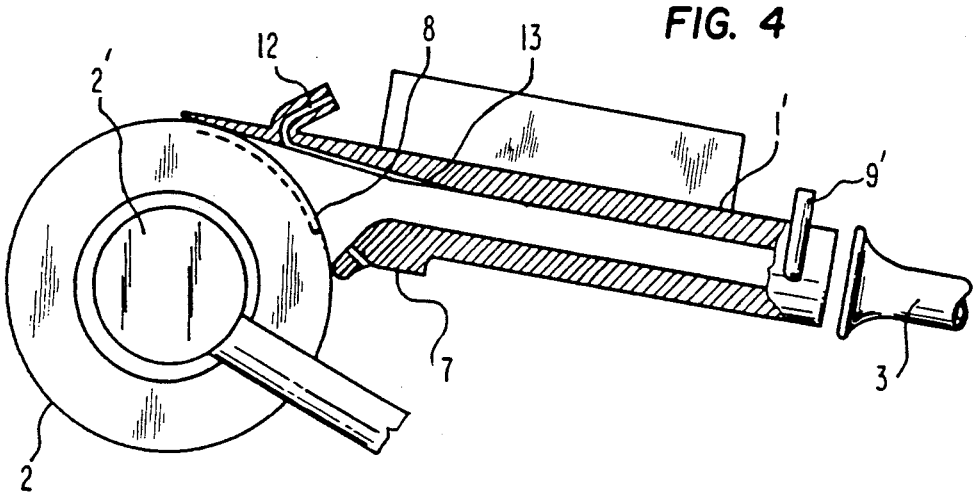
FIG. 4 is a plan view partly in section of another embodiment of the invention.
Figure 5:
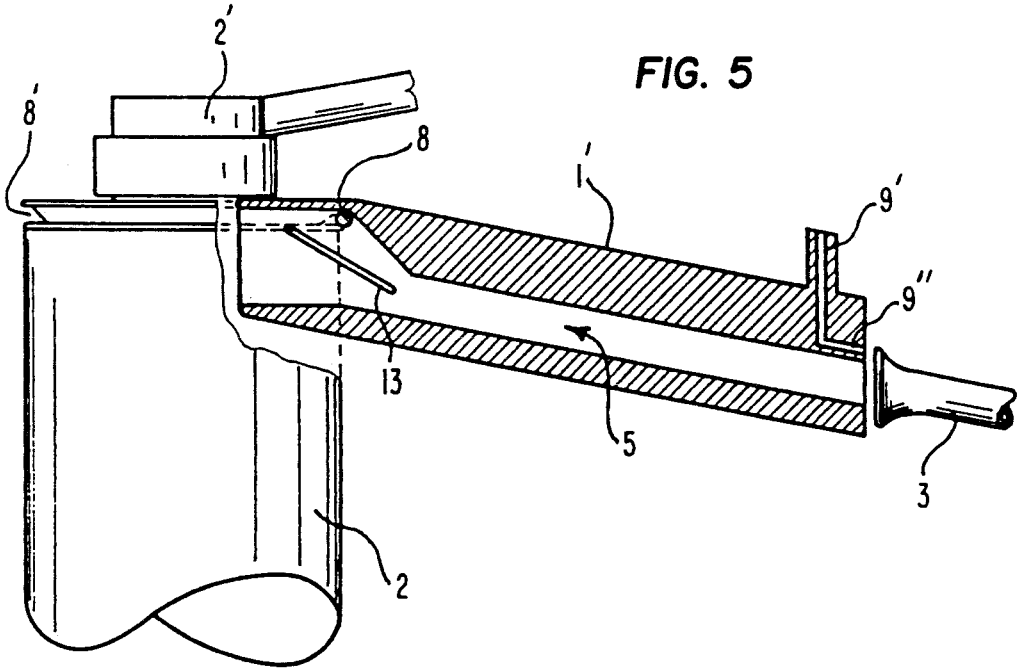
FIG. 5 is a side view partly in section of the device of FIG. 4.
Figure 6:
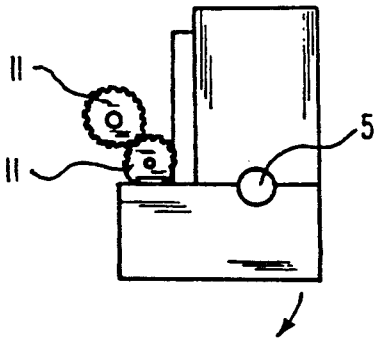
FIG. 6 is a front view of the device of FIGS. 4 and 5.

FIGS. 4, 5 and 6 show an alternative embodiment of the elongate body 1 according to the invention. In these figures, the parts which are unchanged with respect to the preceding figures are indicated by the same references.

In this alternative embodiment, the ducts 4 are substituted by a single duct 12, placed in a more advanced position with respect to the mouth of the body 1' and extending inside the hollow body 1' thanks to a groove 13 provided on the internal surface of said hollow body. This groove 13 is preferably provided in the wall of the chamber, being open only at the point of exit so that the air flows in juxtaposition with the internal surface of the chamber. Thus, with the flow being maintained next to the internal surface of the chamber, the roving will not be in the midst of the air flow when being moved through the chamber. Of course, it is possible to use several other types of ducts, variable in number and position, provided that they give a pneumatic effect of suction and/or push for the roving or yarn inside the body 1.

Other methods and devices can be used for the detachment of the roving end 8, provided that the end 8 of the roving is positioned inside the body entry.

The duct 9' is also different from the corresponding duct 9 of FIG. 2; in fact said duct 9' does not enter the cavity 5 of the elongate body 1', but ends outside and parallel to said cavity with a final section 9'', though remaining in the vicinity of the cavity end.

Finally, FIG. 6 shows a different mechanism to open the elongate body 1', wherein one of the two halves forming said body is rotated as far as to be essentially parallel to the remaining part, so as to avoid any possible interference of the body 1' with the roving during the removal of said body 1' from the latter.

The devices described above and illustrated in FIGS. 1 to 6 are preferred embodiments which utilize a specifically regulated Venturi effect to seize and carry said end 8 of the roving through the elongate hollow body without damaging the roving. In particular, the devices described above provide for a reduction in the air flow rate through the ducts (4, 9, 12) while obtaining at the same time a suction effect at the mouth of the hollow member, the reduction in air flow rate helping to ensure that the roving is not damaged.

However, it is possible to provide different devices using a pneumatic effect to perform said transfer; for example, it is possible to place a duct, feeding a gas under pressure, outside the hollow body, near its mouth, in order to carry said roving end by means of the push exerted on it by the gas jet coming from said duct.

Alternatively, it is possible to provide downstream the elongate hollow body a source of negative pressure, so as to obtain a depression inside said elongate hollow body, by which the roving end is sucked and carried from the bobbin to said predetermined position.

Turning now to the embodiment illustrated in FIGS. 1 to 3, it operates in the following manner: the elongate hollow body 1 is positioned with its mouth in close proximity to the cop 2 to which it matches the contour thereof, similarly to what is shown in FIGS. 1 and 2. The cop 2 is then rotated in the direction of its unwinding (in the case illustrated in FIGS. 1 and 2 the cop will rotate clockwise), preferably by means of a mechanism built for this purpose in the supporting arm 2'. At the same time, the ducts 4, 7 and 9 are fed, taking care that the flow of duct 7 is such as not to interfere with the Venturi effect generated by ducts 4 and that the flow through ducts 4 and 9 is only that which is needed to create the Venturi effect given the close proximity of the mouth of body 1 to the cop 2. As previously mentioned, the jets coming from the ducts 4 cause a depression upstream of their outlets 6 and a pressure downstream of same. When the roving end 8 is brought by the cop 2 rotation in correspondence with the jet coming from duct 7, said end 8 is raised and detached from the cop seat 8' and carried approximately in the central area of said mouth. From here the roving end 8 is submitted to said depression caused by the Venturi effect, is sucked towards the opposite side of the elongate body 1, reaching the openings 6 of ducts 4. Approximately in correspondence with said openings, the roving end 8 is submitted to pressure generated in the end part of body 1 by the jets coming from the same ducts 4 and is then carried up to the end of body 1 adjacent guide tube 3. The jet coming from duct 9 provides the roving end 8 with an additional push necessary to remove it from body 1, and to convey it into the guide tube 3.

At this point, the roving end 8 has run through the whole hollow body 1, while at the same time the cop is unwinding and thus the roving coming from cop 2 continues to pass inside said body 1. To free this roving from the confines of the body 1, the air jets are discontinued and the motor and gears 11 are actuated. This causes the two halves of the elongate body 1 to rotate around their upper side, along which they are hinged, thus opening the body 1. To completely free the roving, it is sufficient to raise the body 1 which can therefore be sent to another cop to repeat the operative cycle.

The device illustrated in FIGS. 4, 5 and 6 operates in a quite similar manner, with the only difference being the different way in which the body 1 opens and the arrangement of the various ducts.

While the foregoing description and figures illustrate the preferred embodiments of a device and method for seizing and moving the end of a roving or sliver in accordance with the present invention, it should be appreciated that certain modifications may be made and are encouraged to be made in the structure arrangement and operation of the disclosed embodiments without departing from the spirit and scope of the present invention which is intended to be defined by the claims which are set forth immediately hereafter.

What is claimed is:

1. A method of seizing and moving the end of a roving from a rotating cylindrical cop, said method comprising:

a. positioning an elongate hollow member having a large opening and an elongate chamber against a side of the rotating cylindrical cop in such a manner that the large opening matches the side of the rotating cop and covers a large portion thereof, and so that the elongate chamber is transverse to the axis of the rotating cop, wherein the arrangement of the large opening with the side of the rotating cop allows air to be entrained into the hollow member;

b. detaching the end of the roving from the rotating cylindrical cop so that the end of the roving is in the mouth of the elongate hollow member;

c. supplying at least a first stream of air or other gas into the elongate hollow member in a direction away from the cop so that the end of the roving is entrained through the elongate chamber of the elongate hollow member; and d. opening said elongate hollow member along its length whereby said elongate hollow member can be moved without interfering with the unwinding of the yarn from the cop.

2. The method in claim 1, wherein the end of the roving is detached by directing a stream of air tangentially against the cop and against the rotation of the cop.

3. The method in claim 1, further including the step of supplying a second stream of air, or other gas, upstream from said first stream of air to facilitate the positioning of the roving at a predetermined position remote from the cop.

4. The method in claim 1, further including a last step of moving the elongate hollow member to a second rotatable cylindrical cop without interfering with the unwinding of the yarn on the initial cop, repeating steps a–c of claim 1 so that the yarn on the second cop could be unwound as needed, and moving the elongate hollow member to a third rotatable cylindrical cop without interfering with the unwinding of the yarn on the second cop.

5. The method in claim 1, including the step of rotating the cop in the unwinding direction to facilitate the detachment of the end of the roving.

6. An apparatus for seizing and moving the end of a roving from a rotatable cylindrical cop, said apparatus comprising:

a. an elongate member having a first end, a second end, and an elongate chamber extending from said first end to said second end, said first end having a large mouth which is constructed and arranged to radially communicate with a side of the cop and cover a large portion thereof, such that when said elongate member is so arranged, said elongate chamber is transverse to the axis of the cop, wherein when said large mouth is in radial communication with a cop, air can be entrained into said elongate chamber;

b. detachment means for detaching the end of the roving from the cop so that the end of the rovings is in said chamber; and c. at least one air supply duct in communication with said chamber, said at least one air supply duct being adapted to supply a stream of air or other gas into said chamber in a direction away from the cop, whereby the end of the roving will be entrained through said chamber to a predetermined position so that the yarn can be unwound from the cop as needed.

7. The apparatus claimed in claim 6, wherein said large mouth of said first end is arcuate in cross-section and has a radius of curvature which is substantially similar to the radius of the cop such that said large mouth can radially communicate with the cop.

8. The apparatus in claim 6, wherein said detachment means comprises a detachment duct adapted to direct a stream of air or other gas at the end of the roving on the cop to effect said detachment of the end of the roving.

9. The apparatus in claim 8, wherein said detachment duct is so constructed and arranged to direct the stream of air or other gas in a substantially tangential manner against the cop.

10. The apparatus in claim 6, including at least one positioning duct at said second end for supplying air to facilitate the positioning of the end of the roving at said predetermined position.

11. The apparatus in claim 10, wherein said elongate member includes hinge means for hingeably opening said elongate member along its length such that after the end of the roving is seized and moved to the predetermined position, said elongate member can be opened and moved away from the roving.

12. The apparatus in claim 11, wherein said elongate member is formed by two halves along its length and includes at least one hinge along the length of said two halves, said halves including mating gears to facilitate the opening of the elongate member, at least one of said gears being controlled to rotate so as to cooperate with the other such gear to open said chamber along its length.

13. The apparatus in claim 12, wherein said two halves comprise two members having axes running transversely through said chamber, said axes being substantially perpendicular to one another when said elongate member is closed and substantially parallel to one another when said elongate member is opened.

14. The apparatus in claim 6, wherein said large mouth includes an edge therearound which defines an imaginary plane and is adapted to communicate with the side of the cop such that the plane is substantially parallel to a tangent line on the rovings wound on the cop.

15. The apparatus in claim 6, wherein said chamber includes an inner surface and a groove therein, and wherein said at least one air supply duct is provided in the area of said large mouth and is connected to said groove such that it supplies air or other gas to said chamber via said groove.

16. The apparatus in claim 15, wherein said groove is arranged on said inner surface so that the air supplied therefrom flows in substantial juxtaposition with said inner surface.

* * * * *